US009533491B1

(12) United States Patent
LeFevre et al.

(10) Patent No.: US 9,533,491 B1
(45) Date of Patent: Jan. 3, 2017

(54) PRINT HEAD JET MAINTENANCE

(71) Applicant: XEROX CORPORATION, Norwalk, CT (US)

(72) Inventors: Jason M. LeFevre, Penfield, NY (US); Michael J. Levy, Webster, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/925,258

(22) Filed: Oct. 28, 2015

(51) Int. Cl.
*B41J 2/045* (2006.01)
*B41J 2/165* (2006.01)

(52) U.S. Cl.
CPC ..... *B41J 2/0451* (2013.01); *B41J 2/04513* (2013.01); *B41J 2/04536* (2013.01); *B41J 2/165* (2013.01); *B41J 2/16517* (2013.01)

(58) Field of Classification Search
CPC ..... B41J 2/165; B41J 2/16517; B41J 2/04536; B41J 2/0451; B41J 2/04513
See application file for complete search history.

(56) References Cited

U.S. PATENT DOCUMENTS

2008/0316247 A1* 12/2008 Cellura ..... B41J 2/0057 347/19
2015/0343819 A1* 12/2015 Groenen ..... B41J 2/16517 347/5

* cited by examiner

*Primary Examiner* — Bradley Thies
(74) *Attorney, Agent, or Firm* — Ronald E. Prass, Jr.; Prass LLP

(57) ABSTRACT

A print strategy periodically inserts sacrificial print media, such as a small number of sacrificial sheets of paper into a print job to exercise underused print head jets and prevent nozzle dry-up and/or degraded jetting integrity. This can be implemented with sacrificial sheets out of a tray used by a current print job or from another paper tray housing, for example, the widest stock currently installed in the image forming device. Jets that need to be exercised can be determined by using Feed-Forward image content from the Image Path, and those jets are exercised to print ink on the sacrificial sheet(s). The sacrificial sheet may be diverted to a bypass tray as scrap. Without the need for a purge cycle, or a cycle-down, the image forming device can continue seamlessly to the next print job without performance loss from using the previously under-used print head jets.

20 Claims, 4 Drawing Sheets

PRINT HEAD JET MAINTENANCE

FIELD OF DISCLOSURE

The disclosure relates to image forming devices. In particular, this disclosure relates to maintenance mechanisms useful for cleaning print heads in image forming devices.

BACKGROUND

Presently, ink jet printing includes ejecting or jetting drops of liquid ink from selected nozzles of a print head to form an image on a print media, such as paper. Some ink jet printers receive ink in its liquid form from containers. Other printers receive ink in a solid form.

The ink jet printing (drop-on-demand) industry continues to be an area of growth as printers & printing equipment manufacturers realize the value of personalized digital content. In a common type of inkjet printing, aqueous ink jet print heads eject ink through an array of nozzles using a drop-on-demand strategy when the image content requires that a drop is needed. The image content of any particular image is entirely up to the user to define, and as such it is not required, and extremely unlikely that all of the ink jets in a print head array would be used or exercised in a particular image. Yet a succeeding image print job would likely utilize ink-jets that were not used on the prior image print job.

When an inkjet image forming device prints different jobs on print media (e.g., paper), which may include print jobs that may have different page widths, there invariably are jets that could print on larger width print media but could not be printed on the narrower sheet. Thus, some jets could not be exercised during printing on more narrow print media. When ink jets are not exercised for an extended length of time (e.g., about 30 minutes or more depending on the chemical makeup of the ink) the ink jets tend to dry-up such that the only way to recover the jets is to initiate an ink purge sequence. Even before ink jet dry-up, some ink jets may partially dry-up sufficiently to impair printing accuracy.

An ink purge cycle can cost the operator time (5-10 minutes/purge cycle), and money. Cost of a traditional ink purge cycle may be $3-5 per purge, multiplied 6-8 times per work-shift equals about $20 to $40 per work shift. It would be beneficial to reduce ink purge cycles while maintaining ink jet performance.

SUMMARY

This summary is provided to introduce a selection of concepts in a simplified form that are further described below in the detailed description. This summary is not intended to identify essential features of the claimed subject matter, nor is it intended for use in determining the scope of the claimed subject matter.

According to aspects illustrated herein, a print strategy periodically inserts sacrificial print media, for example, a small number of sacrificial sheets into a print job to exercise the jets nominally not used in the current print area and prevent nozzle dry-up. This can be implemented by using sacrificial sheets of paper out of the tray used by the current print job or from another paper tray housing, for example, the widest stock currently installed in the image forming device. Jets that need to be exercised can be determined by using feed-forward image content from the image path of current and subsequent print jobs, and preferably only those jets are exercised to print ink on the sacrificial sheet(s). The sacrificial sheet(s) may be diverted to a bypass tray as scrap.

Without the need for a purge cycle, or a cycle-down, the image forming device can continue seamlessly to the next print job without performance loss from using the previously un-used or underused print head jets.

According to aspects illustrated herein, there is provided an ink jet image forming device including a plurality of ink jet print heads, with each print head having a nozzle for depositing marking material onto a print media, and a maintenance controller in data communication with the ink jet print heads. While not being limited to a particular theory, the exemplary maintenance controller may be programmed to determine that the ink jet print heads are active, search current and upcoming print jobs for forward image data while the ink jet print heads are active, map underused print jets over a current predetermined time interval based on the forward image data, design a target image different than the forward image data, and instruct or otherwise cause an immediate printing of the designed target image on a sacrificial print media at the end of the current predetermined time interval.

The exemplary embodiments may include a non-transitory computer readable medium having executable instructions recorded thereon that, when executed by a processor, instructs or otherwise causes the processor to execute steps of a method for maintaining operational inkjet nozzles during operation of an ink jet image forming device having ink jet print heads with nozzles for depositing marking material onto a print media. While not being limited to a particular theory, steps of the method may include determining that the ink jet print heads are active, searching current and upcoming print jobs for forward image data, mapping underused print jets over a current predetermined time interval based on the forward image data, designing a target image different than the forward image data, and instructing or otherwise causing an immediate printing of the designed target image on a sacrificial print media at the end of the current predetermined time interval.

The exemplary embodiments also include a method for maintaining operational inkjet nozzles during operation of an ink jet image forming device having ink jet print heads with nozzles for depositing marking material onto a print media. While not being limited to a particular theory, the exemplary method includes determining that the ink jet print heads are active, while the ink jet print heads are active, searching current and upcoming print jobs for forward image data, mapping underused print jets over a current predetermined time interval based on the forward image data, designing a target image different than the forward image data, and instructing or otherwise causing an immediate printing of the designed target image on a sacrificial print media at the end of the current predetermined time interval.

The immediate printing of the designed target image may include suspending a printing of a current print job, retrieving the sacrificial print media from an infeed sacrificial print media source of the ink jet image forming device, printing the designed target image on the retrieved sacrificial print media, and resuming the printing of a current print job.

Exemplary embodiments are described herein. It is envisioned, however, that any system that incorporates features of systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
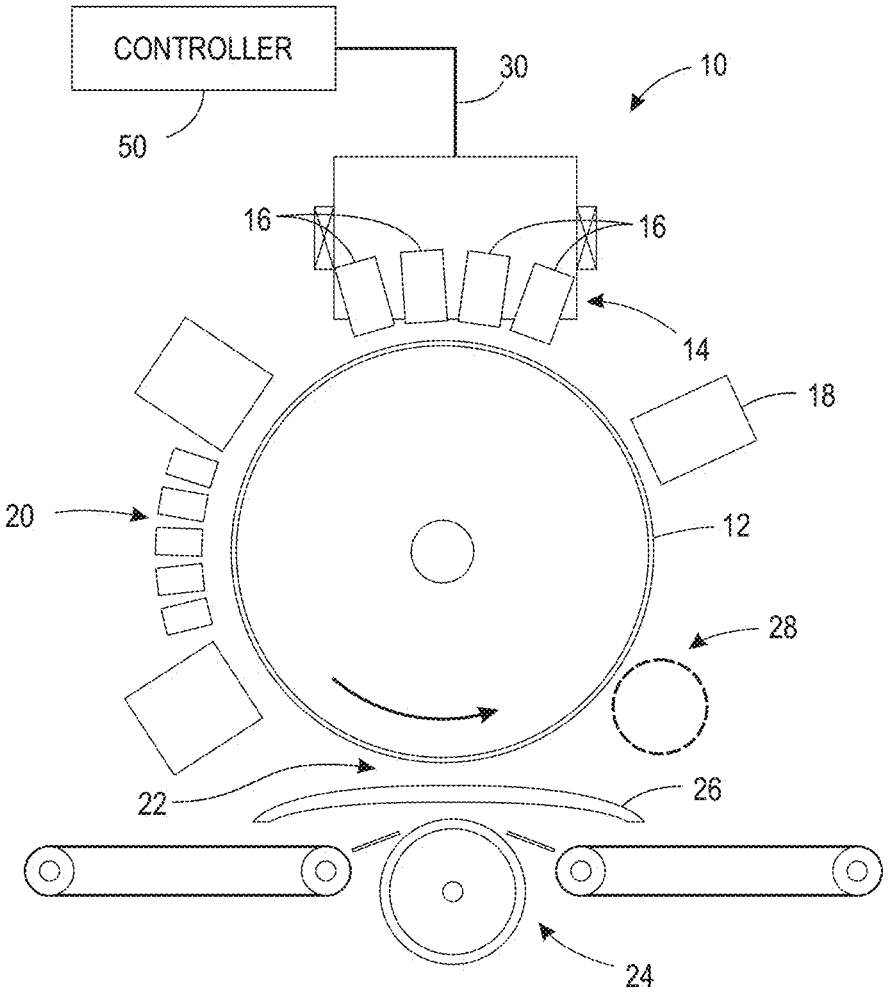
FIG. 1 is side diagrammatical view of an ink jet image forming device in accordance with an exemplary embodiment.

The present invention will be illustrated in more detail with reference to the accompanying drawings to accommodate understanding of image forming devices for toner or ink-based ink-jet printing, which may include direct or offset printing of ink images, and of which preferred embodiments of the invention are shown. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

The term "image forming device" or "printing device" as used herein refers to a digital copier or printer, scanner, image printing machine, xerographic device, digital production press, document processing system, image reproduction machine, bookmaking machine, facsimile machine, multifunction machine, or the like and can include several marking engines, feed mechanism, scanning assembly as well as other print media processing units, such as paper feeders, finishers, print media input/output housings and the like. An image forming device can handle sheets, webs, substrates, marking materials, and the like, and can place marks on any surface.

The term "print media" generally refers to a usually flexible, sometimes curled, physical sheet of paper, substrate, plastic, or other suitable physical print substrate for images, whether precut or web fed. The term "print head," may be defined as any structure from which ink is emitted in imagewise fashion toward the imaging member.

The term "imaging member" is a unit that holds marking material, such as toner or ink, in an imagewise or reverse-imagewise fashion for eventual transfer to print media. In an ink-jet context, an imaging member can be an image-transfer drum or belt that receives marking material from one or more ink-jet print heads and subsequently transfers the marking material to print media.

Image data may include an array of values that are interpreted by the image forming device to print images defined by or corresponding to the image data. Current image data may include an array of values that are currently being printed by the image forming device as corresponding images. Forward image data may include image data ordered for printing after the current image data is printed. Forward image data or feed forward image data may be located in current and subsequent print jobs for printing, typically in an order set within a queue of a current and subsequent print jobs.

Recent patents (e.g., U.S. Pat. Nos. 6,248,163 and 6,846,851) in this field attempted to address the problem of ink jetting latency by adding more humectants to the ink formulation. This however, comes with its own downfall; because when large amounts of humectants are added to the ink it makes the task of drying much more difficult (higher drying power and/or durations are needed for adequate dryness). Sometimes the humectants are UV-curable humectants which add yet another layer of complication with regards to safety and cost. The nature of the high-speed printing for aqueous inkjet makes it very undesirable to have ink that would need enormous amounts of drying power to achieve proper dryness.

Other strategy's to control this problem of ink jetting latency involve printing individual jets in a sparse array throughout the current image is undesirable because of the inherent nature of depositing ink where the incoming image content does not request ink. Darker inks, including black ink, are especially problematic because individual drops can be quite noticeable.

U.S. Pat. No. 6,179,403 suggests performing maintenance cycles periodically depending on the visual detectability of the image content. This method however still requires periodically, the use of a purge cycle which is disadvantageous because of the time & cost required to perform purge cycles.

A current strategy used in Continuous Feed (CF) aqueous ink jet printing is to provide a well for each print head and to spit ink drops into these wells occasionally between pages. CF printing machines may spit ink from print heads outside a printable web width, yet there is no opportunity for print heads to spit between sheets. In some machines the print heads or wells need to be moved in order to position the print heads opposite the wells while in larger machines they can be placed below the paper path. In both cases the wells also are used to collect ink from purges. In the former the time needed for maintenance is long. In the later the reliability of the paper path can be compromised.

While not being limited to a particular theory, exemplary print strategies are discussed via exemplary methods, devices, systems and other structure that periodically inserts sacrificial print media (e.g., a small number, such as 5 or less, of sacrificial sheets) into a running print job that may exercise jets unused or underused in a current print area and prevent nozzle dry-up. An automatic routine may in intervals preferably less than or equal to a predetermined nozzle dry-up time (e.g., less than or equal to about 30 minutes) feed a single or small number of sacrificial sheets for printing of a target image designed to exercise previously un-used or underused print head jets or nozzles. The jets/nozzles that need to be exercised can be determined by using feed-forward image content from the image path, and then those jets can print to the sacrificial print media. Jets/nozzles may be exercised by ejecting ink onto the sacrificial print media. In one example of the invention, only the insufficiently used jets are exercised.

The target image for the sacrificial print media is not created as an image of an existing print job, nor typically considered as part of a final print job, but is specifically designed by the system to exercise the unused or insufficiently used ink jet nozzles. The sacrificial print media may be diverted to a bypass tray of the image forming device as scrap, so that it does not become interleaved with the print job currently in process. Finishing hardware of image forming devices commonly include a bypass tray option often used for proofing.

Under the exemplary embodiments, image forming devices may continue seamlessly to subsequent print jobs that may include the use of print head jets previously un-used or under used without the need for purge cycles, or even a cycle-down. Accordingly, the exemplary print head jet maintenance system and method may eliminate the need for ink purges that would otherwise be necessary for sequential print jobs having ink jets unused in one print set, and required in a later print set. Eliminating the need for purge cycles may save operator time of several minutes per purge cycle and cost. As noted above, the cost of print media, for example, paper used as sacrificial sheets is minimal (e.g., 0.1 to 0.3 cents per sheet) in comparison to several dollars and lost printing time per purge (e.g., $3-5 per purge). Further, the exemplary maintenance strategy may eliminate a need for high levels of humectants in the print ink as proposed in the prior art, which in-turn, reduces the drying power and time needed to adequately dry the prints in the printer.

FIG. 1 depicts an ink jet printing device 10 with which an exemplary ink-jet print head maintenance may be advantageously implemented. The ink jet printing device 10 includes a central reimageable imaging member 12, here shown as an image-transfer drum. A print head 14, which may be an inkjet print head suitable for jetting ink is disposed adjacent the imaging member 12. The print head 14 includes any number of jets or nozzles 16 for jetting marking material (e.g., ink) directly onto a surface of an intermediate substrate or the imaging member.

The ink may be jetted into a dampening fluid layer that is applied by a dampening fluid metering system 18. After jetting the ink directly onto the imaging member 12, the drum may be caused to rotate and transport the jetted ink to a drying system 20. The drying system 20 may be configured for drying the jetted ink, thereby adjusting a viscosity of the ink in preparation for ink transfer to another substrate or print media. Subsequently, the jetted and dried ink may be contact transferred at a nip 22 formed by the imaging member 12 and a separate cylindrical member 24. The ink may be transferred to a print media 26, such as paper, at the nip 22 as an ink image or ink image pattern. With inks in accordance with embodiments, the ink may be transferred with advantageously high efficiency.

In certain ink jet printing system, it should be recognized that an offset roller, not shown in FIG. 1, may first receive the ink image pattern and then transfer the ink image pattern to a substrate according to a known indirect transfer method. Following the transfer of the ink to the print media 26, any residual ink and/or residual dampening fluid should be removed from the reimageable surface of the imaging member 12, preferably without scraping or wearing that surface. Removal of such remaining ink residue may be accomplished through use of some form of cleaning subsystem 28, which may include a first cleaning member such as a sticky or tacky member in physical contact with the reimageable surface of the imaging member 12 to remove residual ink and any remaining small amounts of surfactant compounds from the dampening fluid from the reimageable surface of the imaging member.

While the exemplary embodiments may be described with an aqueous ink jet device, it is understood that the embodiments are not limited to any particular ink or device. The ink contemplated for use in the exemplary embodiments is understood to include any type or color of ink generally used by ink jet image forming or printing devices. Inks that are useful for ink jet printing must possess physical and chemical properties that meet the specific demands of ink jet printing systems such as image forming device 10 shown in FIG. 1 as readily understood by a skilled artisan. For example, the ink must be compatible with materials that it comes into contact with, including an imaging plate and dampening fluid, and print media such as paper, metal, or plastic. The ink must also meet all functional requirements of the image forming devices as imposed by wetting and transfer properties defined by architecture and material sets.

The image forming device 10 may include a print head maintenance controller 50 operatively connected to the print head 14 directly or via a communication link 30 of the image forming device. The print head maintenance controller 50 may transmit activation signals to the print head 14 in accordance with image data to instruct or otherwise cause selected individual drop generators (e.g., jets or nozzles 16) of the print head to eject marking material (e.g., drops of ink) to form the ink image pattern on the print media 26. The activation signals can energize individual jets 16 of the print head 14. As noted above, not all jets 16 are used to exercise (e.g., eject ink) on any image, as the jets that are exercised depends on the image data, the ink image pattern and the dimensions of the print media used to receive the ink image.

Figure 2:
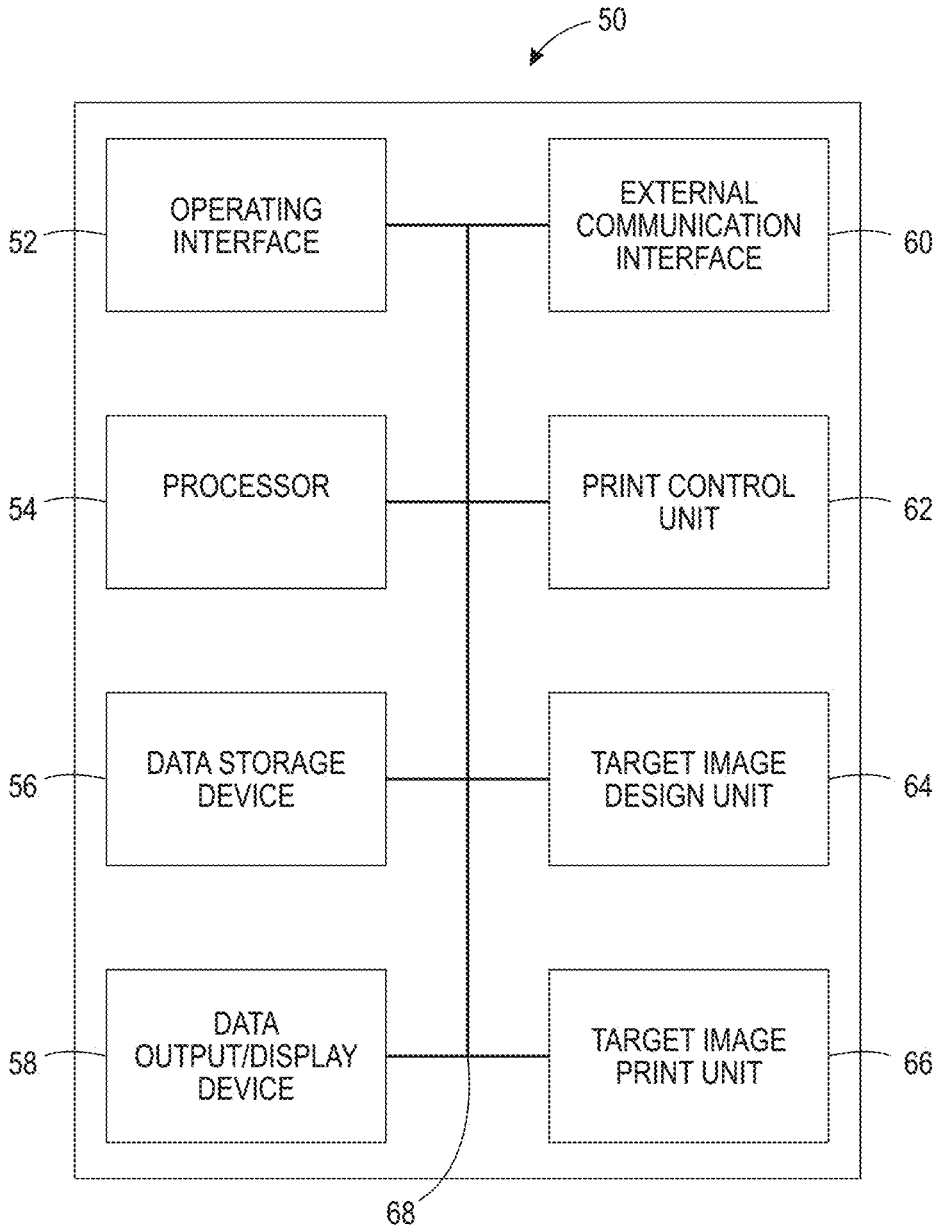
FIG. 2 a block diagram of an print head maintenance controller for maintaining operational inkjet nozzles during operation of an ink jet image forming device according to exemplary embodiments.

FIG. 2 illustrates a block diagram of a print head maintenance controller 50 for automatically maintaining inkjet nozzles operational during operation of an ink jet image forming device according to this disclosure. Components of the print head maintenance controller 50 shown in FIG. 2 may be, for example, housed at an end-user location in a server or in an image forming device 10 that may be monitored and managed by a device management application.

Operation of the print head jet maintenance to the print head jets 16 may be provided by the print head maintenance controller 50 and the image forming device 10. For example, the ink jet image forming device 10 may include the print head maintenance controller 50 as an internal unit or a unit external to the device, with the maintenance controller in data communication with at least the print heads 14 and nozzles 16 thereof.

The print head maintenance controller 50 may include an operating interface 52 by which a user may communicate with the print head maintenance controller 50 and the image forming device 10, or otherwise by which the print head maintenance controller 50 may receive instructions input to it from another source. In instances where the operating interface 52 may be a locally accessible user interface, the operating interface 52 may be configured as one or more conventional mechanisms common to computing and/or image forming devices that permit a user to input information to the print head maintenance controller 50. The operating interface 52 may include, for example, a conventional keyboard and mouse, a touchscreen with "soft" buttons or with various components for use with a compatible stylus, a microphone by which a user may provide oral commands to the print head maintenance controller 50 to be "translated" by a voice recognition program, or other like device by which a user may communicate specific operating instructions to the print head maintenance controller 50.

The print head maintenance controller 50 may include one or more local processors 54 for individually operating the print head maintenance controller 50 and for carrying out processing, assessment, analytical, image design and control functions. Processor(s) 54 may include at least one conventional processor or microprocessor that interprets and executes instructions to direct specific data monitoring, analysis and design functions with regard to image data that is commanded or intended for image forming in a specific image forming device 10. Processor(s) 54 may initiate and control image data collection, analysis and maintenance efforts with respect to commanded or intended image data in an image forming device 10 and hardware thereof, including the jets 16 of the print head 14, with which the print head maintenance controller 50 may be associated. The processor 54 may include other units and controllers shown in the print head maintenance controller 50, with the units and controllers separated for discussion purposes to set forth operational functions provided by the print head maintenance controller in greater detail.

The print head maintenance controller 50 may include one or more data storage devices 56. Such data storage device(s) 56 may be used to store data or operating programs to be used by the print head maintenance controller 50, and specifically the processor(s) 54, in carrying out the image data analysis and maintenance functions of the print head maintenance controller 50 and image forming device 10. Data storage device(s) 56 may be used to collect information regarding any or all of the functions of the print head maintenance controller 50 and image forming device 10, including ordered print jobs. The data storage device(s) 56 may include a random access memory (RAM) or another type of dynamic storage device that is capable of storing collected information, and separately storing instructions for execution of the maintenance controller 50 and image forming device 10 operations by, for example, the processor(s) 54. Data storage device(s) 56 may also include a read-only memory (ROM), which may include a conventional ROM device or another type of static storage device that stores static information and instructions for the processor(s) 54. Further, the data storage device(s) 56 may be integral to the print head maintenance controller 50, an image forming device 10 associated with the print head maintenance controller 50, or may be provided external to, and in wired or wireless communication with, the print head maintenance controller 50.

Still referring to FIG. 2, the print head maintenance controller 50 may include at least one data output/display device 58, which may be configured as one or more conventional mechanisms that output information to a user, including a display screen on a computing or image forming device 10, including a graphical user interface (GUI) on the image forming device.

The print head maintenance controller 50 may include one or more separate external communication interfaces 60 by which the print head maintenance controller may communicate with components external to the print head maintenance controller, such as image forming devices 10 with which the print head maintenance controller 50 may be associated. At least one external communication interface 60 may be configured specifically to facilitate communication between the print head maintenance controller 50 and one or more monitored image forming devices 10 to provide image forming directives such as the immediate printing of a processor designed target image by the image forming device 10. No particular limiting configuration to the external communication interface(s) 60 is to be implied by the depiction in FIG. 2, other than that the external communication interface(s) 60 may be configured to connect to external components via one or more available wired or wireless communication links.

The print head maintenance controller 50 may include a print control unit 62, which may be a part or a function of processor 54 coupled to, for example, one or more storage devices 56, or may be a separate stand-alone component module or circuit in the print head maintenance controller. The print control unit 62 may review data destined for one or more image forming devices, separating image data content from print instructions. Based in part on this review of the image data contents and print instructions, the print control unit 62 may determine whether the print heads are active (e.g., currently in use, not parked in the printer's maintenance station). The print control unit 62 and/or the processor may also determine if the print heads are active via a review of communications between the image forming device 10 and the operating interface 52, data output/display device 58, and external communication interface 60.

While the ink jet print heads are active, the print control unit 62 and/or the processor 54 may search current and upcoming print jobs and analyze current and forward image data in the print jobs, with the forward image data representing current and upcoming print images scheduled for printing by the image forming device. Based on the forward image data, the processor 54 may map which print head jets are being used currently and in the near future to print the scheduled print images. Executing an automatic routine of a device management application, the processor 54 may map current and future use of each print head jet or nozzle at least over a predetermined period of image forming device 10 operation and determine which print head jets will not be sufficiently used over the period. This period may be a predetermined time interval less than an expected time for the jets to dry up completely or partially to a point where performance of the jets is compromised (e.g., less than or equal to about 30 minutes).

The print head maintenance controller 50 may include a target image design unit 64, which may be a part or a function of processor 54, with which the print head maintenance controller 50 may order the creation of a target image data designed to use unused or underused print head jets 16 before they dry up and/or result in degraded jetting integrity. Based on the mapping and determination of which print head jets 16 may not be sufficiently used over the period to prevent performance degrading nozzle dry up and/or partial nozzle dry up resulting in degraded jetting integrity, the target image design unit 64 or the processor 54 designs a target image created to exercise, or use the underused jets. Since the target image is designed to exercise jets insufficiently used over the predetermined time, the target image is different that the image data used in a currently running print job, and is different that forward image data used in subsequent print jobs that may run during the current and next predetermined time intervals. Otherwise, the unused or insufficiently used jets would not get sufficiently exercised before they dry up and/or lose jetting integrity. It should be noted that the designed target image may also exercise print head jets 16 that may not be used during the current and next or subsequent predetermined time intervals because the underused jets may correspond to portions of print media larger that the print media being used during the current predetermined time interval.

The print head maintenance controller 50 may include a target image print unit 66, which may be a part or a function of the processor 54. The target image print unit orders an interrupting sacrificial printing of the target image designed by the target image design unit 64 and/or the processor 54. This printing takes place at the end of a time period that may correspond with the end of a predetermined time interval. The time period may be different that the predetermined time interval, but preferably is still before any nozzle dry up time. The target image print unit 66 and/or the processor 54 orders or causes an immediate printing of the designed target image on the print media, which may be a small number of sacrificial sheets less than or equal to 5. The immediate printing of the designed target image may insert the printing of the target image design unit 64 and/or the processor 54 designed target image within an existing current print job. The immediate printing of the designed target image may include suspending a printing of a current print job, retrieving the sacrificial print media from an infeed sacrificial sheet source of the ink jet image forming device, printing the designed target image on the retrieved sacrificial print media, and resuming the printing of a current print job.

All of the various components of the print head maintenance controller 50, as depicted in FIG. 2, may be connected by one or more data/control busses 68. These data/control busses 68 may provide wired or wireless communication between the various components of the print head maintenance controller 50, whether all of those components are housed integrally in, or are otherwise external and connected to, the print head maintenance controller 50 and image forming device 10.

It should be appreciated that, although depicted in FIG. 2 as what appears to be an integral unit, the various disclosed elements of the print head maintenance controller 50 may be arranged in any combination of sub-systems as individual components or combinations of components, integral to a single unit, or external to, and in wired or wireless communication with the single unit of the print head maintenance controller 50. In other words, no specific configuration as an integral unit or as a support unit is to be implied by the depiction in FIG. 2. Further, although depicted as individual units for ease of understanding of the details provided in this disclosure regarding the print head maintenance controller 50, it should be understood that the described functions of any of the individually-depicted components may be undertaken, for example, by one or more processors 54 connected to, and in communication with, one or more data storage devices 56.

Figure 3:
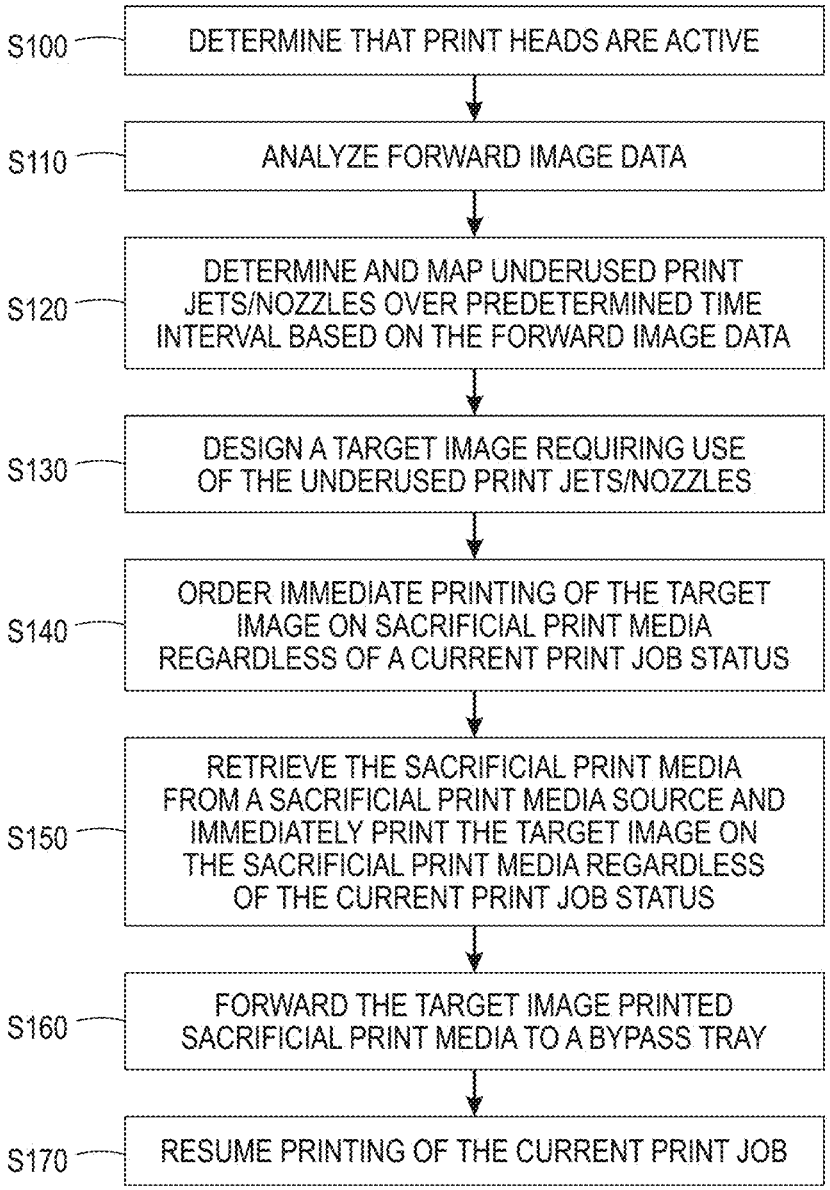
FIG. 3 illustrates a flowchart of an exemplary method for maintaining operational inkjet nozzles during operation of an ink jet image forming device according to exemplary embodiments.

The disclosed embodiments may include an exemplary method for automatically maintaining operational inkjet nozzles during operation of an ink jet image forming device having ink jet print heads with nozzles for depositing marking material onto a print media. FIG. 3 illustrates a flowchart of such an exemplary method. As shown in FIG. 3, operation of the method commences at Step S100, where image forming device 10 or the print head maintenance controller 50 determines if the ink jet print heads 14 are active. This may be determined by an investigation of whether the image forming device 10 is running a print job or printing an image, since such activity would require active print heads. If the print heads are active, the print head maintenance controller 50 may search current and upcoming print jobs for forward image data at Step S110, and may determine the print images corresponding to the forward image data.

Based on the searched forward image data and corresponding print images, at Step S120 the print head maintenance controller 50 may determine which print head jets 16 are being underused during a predetermined time interval less than the known time for nozzle dry up, and map the underused print jets. The print head maintenance controller 50 may also continuously monitor the print head jets 16 and keep track of the jets that have been inactive the longest, or at least during a time interval less than the known time for nozzle dry up and most in need for exercising. The print head maintenance controller 50 may also determine which nozzles have not been exercised during the current predetermined time interval as underused nozzles. The print head maintenance controller 50 may also map underused print nozzles over a next predetermined time interval based on the forward image data to determine which nozzles will not be exercised during a remainder of a current predetermined time interval and the next predetermined time interval as underused nozzles. The print head maintenance controller 50 may also map underused print jets over a next predetermined time interval based on the forward image data and determine which nozzles will not be used during a consecutive predetermined time interval within the current predetermined time interval and a next predetermined time interval immediately thereafter as underused nozzles. The consecutive predetermined time interval is preferably less than the time for a change in condition of an unused or underused ink jet nozzle from operable to degraded. The print head maintenance controller 50 may also determine current and upcoming print jobs that will be execute during the current predetermined time interval.

As noted above, the current predetermined time interval may be, and in examples preferably is, less than or equal to the time for an unused or underused ink jet nozzle to dry up and/or result in degraded jetting integrity. The specific current predetermined time interval may be determined based on the usage of the print head nozzles. In addition, the specific current predetermined time interval may be determined based on current, previously executed, or subsequently executed print jobs of image data.

Based on which print head jets/nozzles 16 are determined to be underused, and thus in jeopardy of drying up and/or in jeopardy for degraded jetting integrity, at Step S130, the target image design unit 64 and/or the processor 54 designs a target image created to exercise, or use the underused jets. The printing of the target image preferably requires the use or exercising of the underused nozzles 16. Moreover, the target image may be designed to use or exercise only the nozzles 16 determined to be underused or unused during a predetermined time interval to avoid nozzle dry up. In this aspect, the designed target image may ignore sufficiently used nozzles that are not in danger of dry up during a current or subsequent predetermined time interval.

In the examples, designing the target image may include designing the target image that requires use of the underused nozzles during the printing of the target image over the current predetermined time interval. In the examples, designing the target image may include designing the target image that requires use of the underused nozzles during the printing of the target image over the next predetermined time interval, with the next predetermined time interval being less than or equal to the time for a change in condition of an underused ink jet nozzle from operable to degraded. In the examples, designing the target image may include designing the target image that requires use of the underused nozzles during the printing of the target image at the end of a current predetermined time interval. In the examples, designing the target image may include designing the target image based on the forward image data. In the examples, designing the target image may include designing the target image to exercise only the nozzles underused during printing of the forward image data by requiring the emission of the marking material through only the underused nozzles onto the sacrificial sheet based on image data missing from the forward image data.

At Step S140 the target image print unit 66 and/or the processor 54 orders an immediate printing of the designed target image on sacrificial print media, which may be a small number of sacrificial sheets less than or equal to 5. The sacrificial print media used for exercising underused jets may be about 1-3 sacrificial sheets. In the examples, the target image print unit 66 and/or the processor 54 may instruct or otherwise cause an immediate printing of the designed target image on at least one sacrificial sheet of the print media at the end of the current predetermined time interval regardless of a current print job status or completion. In the examples, the processor 54 may determine a size of the print media being used for receipt of the forward image data, the target image design unit 64 and/or the processor 54 may design a target image larger than the size of the print media being used for the current print job, and the target image print unit 66 may instruct or otherwise cause the immediate printing of the designed target on at least one sacrificial sheet having a size larger than the size of the print media being used for the current print job. In the examples, the target image print unit 66 and/or the processor 54 may instruct or otherwise cause the immediate printing of the designed target on at least one sacrificial sheet having a size sufficient to receive ink from the firing of all print head nozzles 16 in the ink jet image forming device 10.

As noted above, and set forth in Step S150, the immediate printing of the designed target image may include inserting the printing of the processor 54 designed target image immediately or at the end of a predetermined time interval. This immediate printing may include suspending a printing of a current print job, retrieving the sacrificial sheet from an infeed sacrificial sheet source of the ink jet image forming device, printing the designed target image on the retrieved sacrificial sheet, and resuming the printing of a current print job. Further, the ordering or causing of the immediate printing at Step S150 may instruct or otherwise cause retrieval of sacrificial print media from a sacrificial print media source and printing the target image on the sacrificial print media regardless of the status or completion of the current print job. Thus, the immediate printing of the designed target image may include printing the designed target image on the retrieved sacrificial print media while the jet ink image forming device is executing a current print job. In the examples, the ink jet image forming device 10 may have a plurality of print media sources, and the processor 54 may determine one of the print media sources that houses the largest print media used in the ink jet image forming device. In this aspect, the immediate printing of the designed target image at Step S150 may include retrieving sacrificial media (e.g., at least one sacrificial sheet) from the determined print media source that houses the largest print media used in the ink jet image forming device.

At Step S160, the processor 54 instructs or otherwise causes the ink jet image forming device 10 to forward the sacrificial print media printed with the target image to a bypass tray of the ink jet image forming device. In the examples, the sacrificial print media printed with the target image may be forwarded to a bypass tray of the ink jet image forming device 10 different than the regular output tray used for the print jobs. The sacrificial print media may be diverted to the bypass tray as scrap, so that it does not become interleaved with the print job currently in process. At Step S170, the ink jet image forming device 10 resumes printing of any current print job. Steps S110-S170 may be repeated while the print heads are active.

Figure 4:
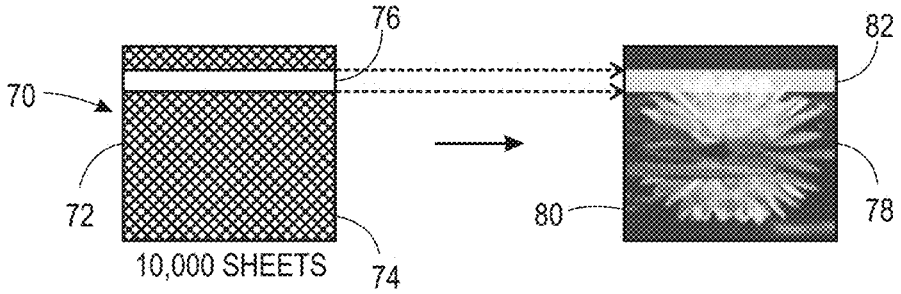
FIG. 4 shows a demonstrative output of a related art print strategy.

FIG. 4 depicts a demonstrative output of a related print strategy, with a first print job 70 of image data resulting in a first image 72 printed on a number of sheets 74 (e.g., about 10,000 sheets) by an image forming device 10 based on current image data. The sheets 74 show a section 76 without ink, which indicates that specific jets 16 of the image forming device 10 are not being used to print the first image 72. If sheets with the first image 72 having the section 76 are run for a time, for example about 30 minutes or more, the specific jets 16 that correspond to the section 76 may dry up at least to an extent that degrades nozzle accuracy and performance.

Still referring to FIG. 4, a subsequent print job produces a second image 78 on sheets 80. As can be seen from the demonstrative output, due to full or partial nozzle dry up and/or degraded jetting integrity from underuse during the printing of the first image 72 on sheets 74, the specific jets/nozzles 16 that would be used to eject marking material on section 76 have degraded performance and are unable to sufficiently emit ink as needed for an accurate printing of the second image 78 on sheets 80. A section 82 of the second image 78 printed on sheets 80 corresponding to the section 76 is shown where jets 16 constructed to emit a type and color of ink (e.g., aqueous black ink) are insufficiently able or unable due to nozzle dry up from non-use or underuse during the printing of the large print job (e.g., about 10,000 sheets) of the first image 72. To repair the dried up nozzles, a purge is needed in between sequential sets of the large print jobs, and in particular after large print jobs of, for example about 10,000 sheets.

Figure 5:
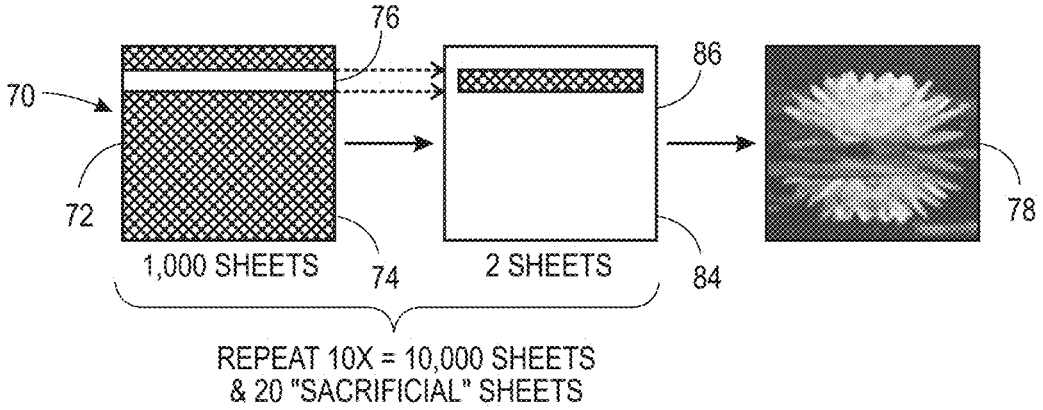
FIG. 5 shows a demonstrative output based on an exemplary method for maintaining operational inkjet nozzles according to exemplary embodiments.

FIG. 5 depicts a demonstrative output of a method for maintaining operational inkjet nozzles 16 without ink purges according to exemplary embodiments. Here, instead of running the first print job 70 of about 10,000 sheets of paper consecutively, the ink forming device 10 inserts a small number of sacrificial print media 84 (e.g., about 2 sacrificial sheets) after the printing of every thousand sheets 74 of the first image 72. In this example, the ink forming device 10 may print out about 1,000 sheets within a predetermined time period less than dry up time (e.g., less than or equal to about 30 minutes). The target image design unit 64 and/or the processor 54 designs a target image 86 created to exercise, or use the jets 16 underused during the first print job 70. The target image print unit 66 and/or the processor 54 instructs or otherwise causes an immediate printing of the designed target image 86 on sacrificial print media 84.

As can be seen by the exemplary output of FIG. 5, the designed target image 86 exercises the previously underused jets 16, resulting in an output different than the first image 72, as the designed target image uses jets underused in printing the first image. Accordingly, printing the designed target image 86 may cover the section 76 with the ink from jets 16 previously underused. Thus, in this example, the jets 16 un-used or under used in the first image 72 are exercised periodically (e.g., every 1,000 sheets, before dry up time) to emit aqueous black ink onto 2 sheets of sacrificial print media to form the target image. This periodic exercising maintains the jets in an active useable state, so the image forming device 10 may go directly to a next or subsequent print job, or to a different image in the same print job, and print the second image 78 without performance loss and without a timely and expensive purge.

The disclosed embodiments may include a non-transitory computer-readable medium storing executable instructions which, when executed by a processor (e.g., processor 54), may cause the processor to execute all, or at least some, of the steps of the method outlined above.

The above-described exemplary systems and methods reference certain conventional components to provide a brief, general description of suitable processing environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by a processor (e.g., processor 54). Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in data computing and communicating network environments with many types of communication equipment, computer system configurations, and image forming devices. Embodiments according to this disclosure may be practiced in distributed computing, communicating and image forming environments where tasks are performed by local and remote actual and virtualized processing devices that may be linked to each other by hardwired links, wireless links, or a combination of both through a communication network. In a distributed computing/communicating environment, program modules may be located in both local and remote memory storage devices.

As indicated above, embodiments within the scope of this disclosure may also include computer-readable media having stored computer-executable instructions or data structures that can be accessed, read and executed by one or more processors (e.g., processor 54). Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communications connection, whether wired, wireless, or in some combination of the two, the receiving processor properly views the connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor (e.g., processor 54).

The exemplary depicted sequence of executable instructions or associated data structures represents one example of a corresponding sequence of acts for implementing the functions described in the steps. The exemplary depicted steps may be executed in any reasonable order to effect the objectives of the disclosed embodiments. No particular order to the disclosed steps of the method is necessarily implied by the depiction in FIG. 3, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure. For example, the principles of the disclosure may be applied to each individual image forming device of a plurality of image forming devices where individual image forming devices or groups of the image forming devices have associated with them device management applications for communication with a plurality of users or print job ordering sources. Each image forming device may include some portion of the disclosed system and execute some portion of the disclosed method but not necessarily all of the system components or method steps.

It will be appreciated that the above-disclosed and other features and functions, or alternatives thereof, may be desirably combined into many other different systems or applications. Various presently unforeseen or unanticipated alternatives, modifications, variations or improvements therein may be subsequently made by those skilled in the art. This may include image forming devices that use jets to emit other fluids, such as conditioning or releasing fluids.

What is claimed is:

1. A method for maintaining operational inkjet nozzles during operation of an ink jet image forming device having ink jet print heads with nozzles for depositing marking material onto a print media, comprising:

a) determining that the ink jet print heads are active;

b) while the ink jet print heads are active, searching current and upcoming print jobs for forward image data;

c) mapping underused print jets over a current predetermined time interval based on the forward image data;

d) designing a target image different than the forward image data; and e) causing an immediate printing of the designed target image on a sacrificial print media at the end of the current predetermined time interval, the immediate printing of the designed target image including suspending a printing of a current print job, retrieving the sacrificial print media from an infeed sacrificial print media source of the ink jet image forming device, printing the designed target image on the retrieved sacrificial print media, and resuming the printing of a current print job.

2. The method of claim 1, further comprising repeating steps b) through e) while the print heads are active for each successive predetermined time interval, each successive predetermined time interval being less than or equal to the time for a change in condition of an underused ink jet nozzle from operable to degraded.

3. The method of claim 1, further comprising forwarding the sacrificial print media to a bypass tray of the ink jet image forming device.

4. The method of claim 1, the step e) including determining a size of the print media being used for receipt of the forward image data, and ordering the immediate printing of the designed target on the sacrificial print media having a size larger than the size of the print media being used for receipt of the forward image data.

5. The method of claim 1, the step e) including ordering the immediate printing of the designed target on the sacrificial print media having a size sufficient to receive ink from the firing of all print head nozzles in the ink jet image forming device.

6. The method of claim 1, the ink jet image forming device having a plurality of print media sources, and further comprising determining one of the plurality of print media sources that houses the largest print media used in the ink jet image forming device, the immediate printing of the designed target image including retrieving the sacrificial print media from the determined one of the plurality of print media sources.

7. The method of claim 1, wherein the print media is stored in a first paper tray and the sacrificial print media is stored in a second paper tray different than the first paper tray.

8. The method of claim 1, the immediate printing of the designed target image further including printing the designed target image on the retrieved sacrificial print media while the jet ink image forming device is executing a current print job.

9. The method of claim 1, further comprising determining which nozzles have not been exercised during the current predetermined time interval as underused nozzles, and the step of designing the target image including designing the target image that requires use of the underused nozzles during the printing of the target image over the current predetermined time interval.

10. The method of claim 1, further comprising mapping underused print jets over a next predetermined time interval based on the forward image data, determining which nozzles will not be exercised during the next predetermined time interval as underused nozzles, and the step of designing the target image including designing the target image that requires use of the underused nozzles during the printing of the target image over the next predetermined time interval, the next predetermined time interval being less than or equal to the time for a change in condition of an underused ink jet nozzle from operable to degraded.

11. The method of claim 1, further comprising mapping underused print jets over a next predetermined time interval based on the forward image data, determining which nozzles will not be used during a consecutive predetermined time interval within the current predetermined time interval and a next predetermined time interval immediately thereafter as underused nozzles, the consecutive predetermined time interval being less than or equal to the time for a change in condition of an underused ink jet nozzle from operable to degraded, and the step of designing the target image including designing the target image that requires use of the underused nozzles during the printing of the target image at the end of the current predetermined time interval.

12. The method of claim 1, the step of ordering an immediate printing of the designed target image on a sacrificial print media including interrupting printing of a print job being executed by the jet ink image forming device, inserting an interrupting print job including interrupting print data corresponding to the designed target image to print the designed target image, and resuming printing of the print job after the printing of the designated target image.

13. The method of claim 1, the step of designing the target image including designing the target image based on the forward image data.

14. The method of claim 13, the step of designing the target image further including designing the target image to exercise only the nozzles underused during printing of the forward image data by requiring the emission of the marking material through only the underused nozzles onto the sacrificial print media based on image data missing from the forward image data.

15. The method of claim 1, further comprising, before Step d), determining the current and upcoming print jobs that will be execute during the current predetermined time interval, and the step of designing the target image including designing the target image based on the forward image data corresponding to the determined current and upcoming print jobs.

16. The method of claim 1, wherein the current predetermined time interval is less than or equal to the time for an underused ink jet nozzle to dry up.

17. The method of claim 1, further comprising, before Step c), determining the current predetermined time interval based on the usage of the print head nozzles.

18. The method of claim 1, further comprising, before Step c), determining the current predetermined time interval based on current and previously executed print jobs of image data.

19. A non-transitory computer readable medium having executable instructions recorded thereon that, when executed by a processor, cause the processor to execute steps of a method for maintaining operational inkjet nozzles during operation of an ink jet image forming device having ink jet print heads with nozzles for depositing marking material onto a print media, comprising:

a) determining that the ink jet print heads are active;

b) while the ink jet print heads are active, searching current and upcoming print jobs for forward image data;

c) mapping underused print jets over a current predetermined time interval based on the forward image data;

d) designing a target image different than the forward image data; and e) causing an immediate printing of the designed target image on a sacrificial print media at the end of the current predetermined time interval, the immediate printing of the designed target image including suspending a printing of a current print job, retrieving the sacrificial print media from an infeed sacrificial print media source of the ink jet image forming device, printing the designed target image on the retrieved sacrificial print media, and resuming the printing of a current print job.

20. An ink jet image forming device, comprising:

a plurality of ink jet print heads, each print head having a nozzle for depositing marking material onto a print media; and a maintenance controller in data communication with the ink jet print heads that is programmed to determine that the ink jet print heads are active, while the ink jet print heads are active, search current and upcoming print jobs for forward image data, map underused print jets over a current predetermined time interval based on the forward image data, design a target image different than the forward image data, and cause an immediate printing of the designed target image on a sacrificial print media at the end of the current predetermined time interval, the immediate printing of the designed target image including suspending a printing of a current print job, retrieving the sacrificial print media from an infeed sacrificial print media source of the ink jet image forming device, printing the designed target image on the retrieved sacrificial print media, and resuming the printing of a current print job.

* * * * *